US008231159B2

(12) United States Patent
Raihala

(10) Patent No.: US 8,231,159 B2
(45) Date of Patent: Jul. 31, 2012

(54) SEVERE DUTY GRAPPLE WITH TUBULAR PIVOT

(75) Inventor: Daniel J. Raihala, Superior, WI (US)

(73) Assignee: Genesis Attachments, LLC, Superior, WI (US)

( * ) Notice: Subject to any disclaimer, the term of this patent is extended or adjusted under 35 U.S.C. 154(b) by 158 days.

(21) Appl. No.: 12/728,669

(22) Filed: Mar. 22, 2010

(65) Prior Publication Data

US 2011/0227355 A1 Sep. 22, 2011

(51) Int. Cl.
*B66C 1/00* (2006.01)
*B66C 1/42* (2006.01)

(52) U.S. Cl. ..... 294/106; 294/192; 414/739

(58) Field of Classification Search ..... 294/81.61, 294/86.4, 104, 106, 198, 199, 202, 192, 86.41; 414/685, 722, 729, 735, 739; 37/403, 406, 37/466, 468, 903

See application file for complete search history.

(56) References Cited

U.S. PATENT DOCUMENTS

| | | | | |
|---|---|---|---|---|
| 3,767,070 | A | 10/1973 | Arnold | |
| 3,802,731 | A | 4/1974 | LaBounty | |
| 3,964,778 | A | 6/1976 | Jouppi | |
| 4,012,069 | A * | 3/1977 | Carson | 294/68.23 |
| 4,017,114 | A | 4/1977 | LaBounty | |
| 4,248,471 | A | 2/1981 | LaBounty | |
| 4,413,945 | A | 11/1983 | LaBounty | |
| 5,553,408 | A * | 9/1996 | Townsend | 37/406 |
| 6,267,547 | B1 * | 7/2001 | Lund | 414/697 |
| 6,527,311 | B1 | 3/2003 | Burke et al. | |
| 6,601,891 | B1 * | 8/2003 | Gregory, Jr. | 294/197 |
| 6,640,471 | B2 | 11/2003 | Desrochers | |
| 7,207,610 | B1 * | 4/2007 | Kauppila | 294/198 |
| 7,818,901 | B2 * | 10/2010 | Zeno et al. | 37/406 |
| 2008/0238116 | A1 | 10/2008 | Stamey et al. | |

FOREIGN PATENT DOCUMENTS

| | | | |
|---|---|---|---|
| DE | 9210765 | U1 | 10/1992 |
| JP | 2009 024837 | A | 2/2009 |

OTHER PUBLICATIONS

International Search Report and Written Opinion for PCT/US2011/029334, mailed Sep. 5, 2011.

Supplementary International Search Report for PCT/US2011/029334, mailed Feb. 9, 2012.

* cited by examiner

*Primary Examiner* — Dean Kramer
*Assistant Examiner* — Stephen Vu
(74) *Attorney, Agent, or Firm* — Gerald E. Helget; Nelson R. Capes; Briggs and Morgan, P.A.

(57) ABSTRACT

An improved severe duty grapple for attachment onto the end of a dipper stick of a backhoe has an arcuate-shaped upper jaw with an inner end and a backside. The upper jaw is pivotally attached near its inner end on its backside to the end of a dipper stick and a double action actuator or cylinder for operative pivotal movement of the upper jaw relative to the dipper stick. An arcuate-shaped lower jaw is provided with an inner end and a backside. The lower jaw is attached near its inner end on its backside to the dipper stick by a linkage for operative pivotal movement of the upper jaw relative to the lower jaw. A hollow tubular pivot is attached to the inner end of one of the jaws with open opposing ends. Two lug plates are mounted on the inner end of the other jaw each with an eyelet. The eyelets are alignable with the open ends of the tubular pivot. A pivot pin is passed through the tubular pivot and eyelets and secured thereat.

18 Claims, 7 Drawing Sheets

SEVERE DUTY GRAPPLE WITH TUBULAR PIVOT

BACKGROUND OF THE INVENTION

This invention relates to backhoes, and more particularly, to an improved severe duty grapple with a tubular pivot.

Bulldozers, front-end loaders and trucks have long been used for road work, clearing brush, and demolition of condemned buildings. In the early 1970's, grapple assemblies on a backhoe boom were developed and have proved to be extremely valuable for a variety of uses, especially for building demolition. Grapple assemblies typically have a pivotal upper jaw and a fixed lower jaw. Grapples can be used for crushing, raking and loading of debris. Examples of such early grapples are disclosed in U.S. Pat. Nos. 3,802,731; 4,017,114; 4,248,471; and 4,413,945.

Over the years since the early 1970's, grapples have still pretty much remained the same and are illustrated in FIGS. 1-3. Backhoe grapple assembly 10 is typically pivotally connected to the stick and further connected with the stick through actuators or cylinders 14 and optionally rigid linkages 16. Stick 12 is connected to the boom which is connected to the backhoe which would utilize a grapple.

Past grapple assemblies would typically include an arcuate-shaped upper jaw or clam shell 18 with rake tips 20 having a backside 26 with stick mount plates 28. Opposite the rake tips 20 is the inner end 22. Load engaging plates 24 are typically between the rake tips 20 and the inner end 22. A lower arcuate-shaped jaw or clam shell 32 similarly has rake tips 34 opposite from the inner end 36 in between which are located load engaging plates 38. On the backside 40 of the lower jaw 32 are stick mount plates 42. The stick mount plates 28 and 42 are suitably connected to the stick 12 of the backhoe and further connected by linkages with the cylinder 14 and linkage 16 or alternatively another cylinder 14 should the lower jaw 32 be desirably moveable.

As can clearly be seen, prior backhoe grapple assemblies 10 have a substantially open throat 50. The upper jaw 18 suitably has two upper lug plates 56 with eyelets into which are welded two machined sleeves 58 into which are mounted 2 pivot bushings 60. On the lower jaw 32 are located 4 lower lug plates 62 with eyelets each having a welded machine sleeve 64 welded into each eyelet. Two pivot pins 66 are utilized in the prior grapple assemblies of FIGS. 2 and 3 while a single pivot pin 68 may be utilized in the grapple assembly of FIG. 1. The pivot pins 68 or 66 are suitably held in place such as by a keeper 70.

The most significant problems with prior known grapple assemblies 10 is that the substantially open throat 50 allows debris D to get into the throat 50 to possibly abrade and cut into lug plates 56 and 62 as well as wear on pivot pin 66 or 68 and sometimes possibly nicking and damaging the rams of the actuators or cylinders 14 all of which can eventually render the grapple assembly 10 to be inoperative requiring replacement, rebuilding or significant repair.

Another significant problem is that the lug plates 56 and 62 of the upper and lower jaws 18 and 32 wear upon each other eventually causing significant slack and sloppiness in the operation of the jaws 18 and 32 with respect to each other. This also means that the grapple becomes extremely noisy with more wear during its operation.

Another significant disadvantage of past known grapple assemblies includes the multitude of parts to include 6 lug plates 56 and 62, and six machined sleeves 58 and 64 to be welded in place along with the associated wear of all of these parts.

There is a need for a severe duty grapple that will not utilize so many lug plates and machined sleeves that will have a substantially closed throat that will provide for extended operation without rebuilding in a smooth fashion with all of the stick mounts, lug plates, pivot pins being protected from damage caused by debris otherwise in an open throat 50.

SUMMARY OF THE INVENTION

An improved severe duty grapple for attachment onto the end of a dipper stick of a backhoe has an arcuate-shaped upper jaw with an inner end and a backside. The upper jaw is pivotally attached near its inner end on its backside to the end of a dipper stick and a double action actuator or cylinder for operative pivotal movement of the upper jaw relative to the dipper stick. An arcuate-shaped lower jaw is provided with an inner end and a backside. The lower jaw is attached near its inner end on its backside to the dipper stick by a linkage for operative pivotal movement of the upper jaw relative to the lower jaw. A hollow tubular pivot is attached to the inner end of one of the jaws with open opposing ends. Two lug plates are mounted on the inner end of the other jaw each with an eyelet. The eyelets are alignable with the open ends of the tubular pivot. A pivot pin is passed through the tubular pivot and eyelets and secured thereat.

A principal object and advantage of the present invention is that the present grapple has less parts than prior grapple assemblies. That is, the present invention only has two lug plates instead of six lug plates of past known grapple assemblies.

Another object and advantage of the present invention is that the severe duty improved grapple has a substantially closed throat protecting the pivot groups, lug plates, pivot pins, linkages and cylinders from wear and tear of debris rubbing against these components.

Another object and advantage as a present invention is that its pivot group is much more rigid than previously hereto known and hence offers more long-term strength and durability over prior known grapple assemblies.

Another object and advantage of the present invention is that with less pivot group parts, the present invention is significantly cheaper to make and easier to maintain than previously known grapple assemblies.

Another object and advantage of the present invention is that the components of the upper and lower jaws are not touching each other to cause premature wear but rather are protected from each other by a unique pivot bushing and flange arrangement suitably made from manganese bronze.

Another object and advantage of the present invention is that its pivot group is much more rigid than previous grapple assemblies assuring a longer life, less noisy operation and greater strength capacity for crushing and demolition usage.

DETAILED SPECIFICATION

Figure 1:
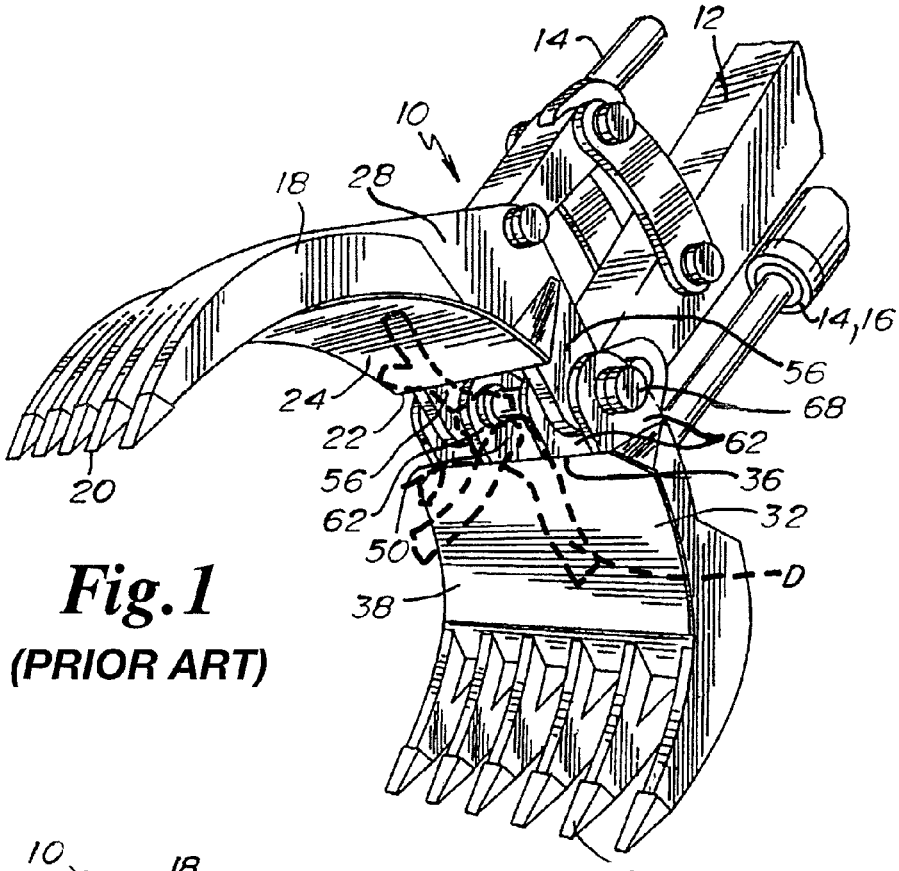
Fig. 1 (PRIOR ART)
FIG. 1 is a prior art view of a front perspective backhoe grapple assembly shown mounted on a dipper stick partially broken away.
Figure 2:
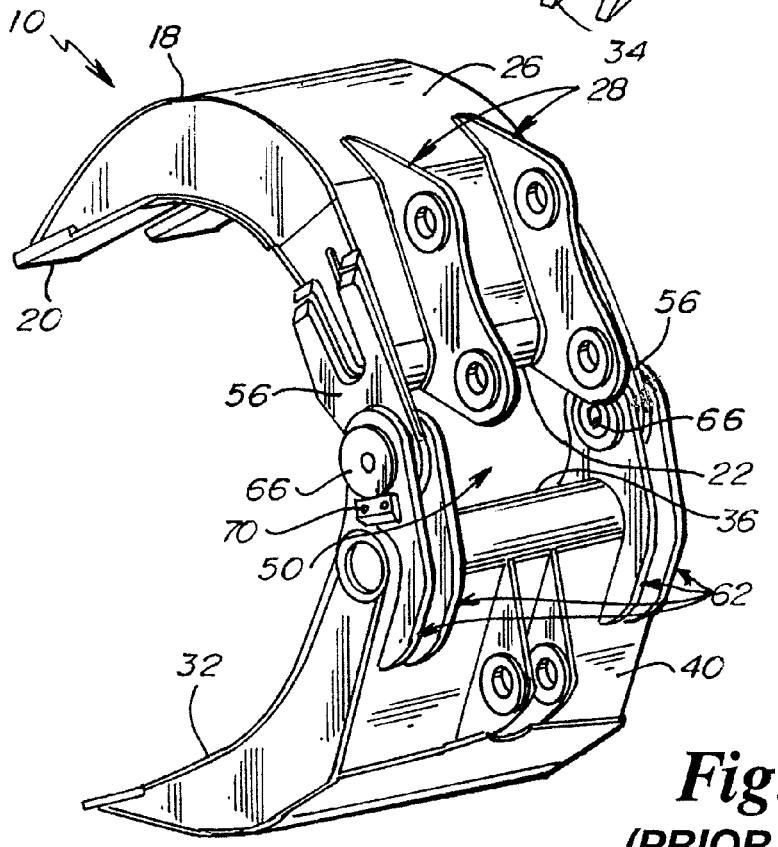
Fig. 2 (PRIOR ART)
FIG. 2 is a rear perspective view of a prior art grapple assembly showing the open throat and six lug plates.
Figure 3:
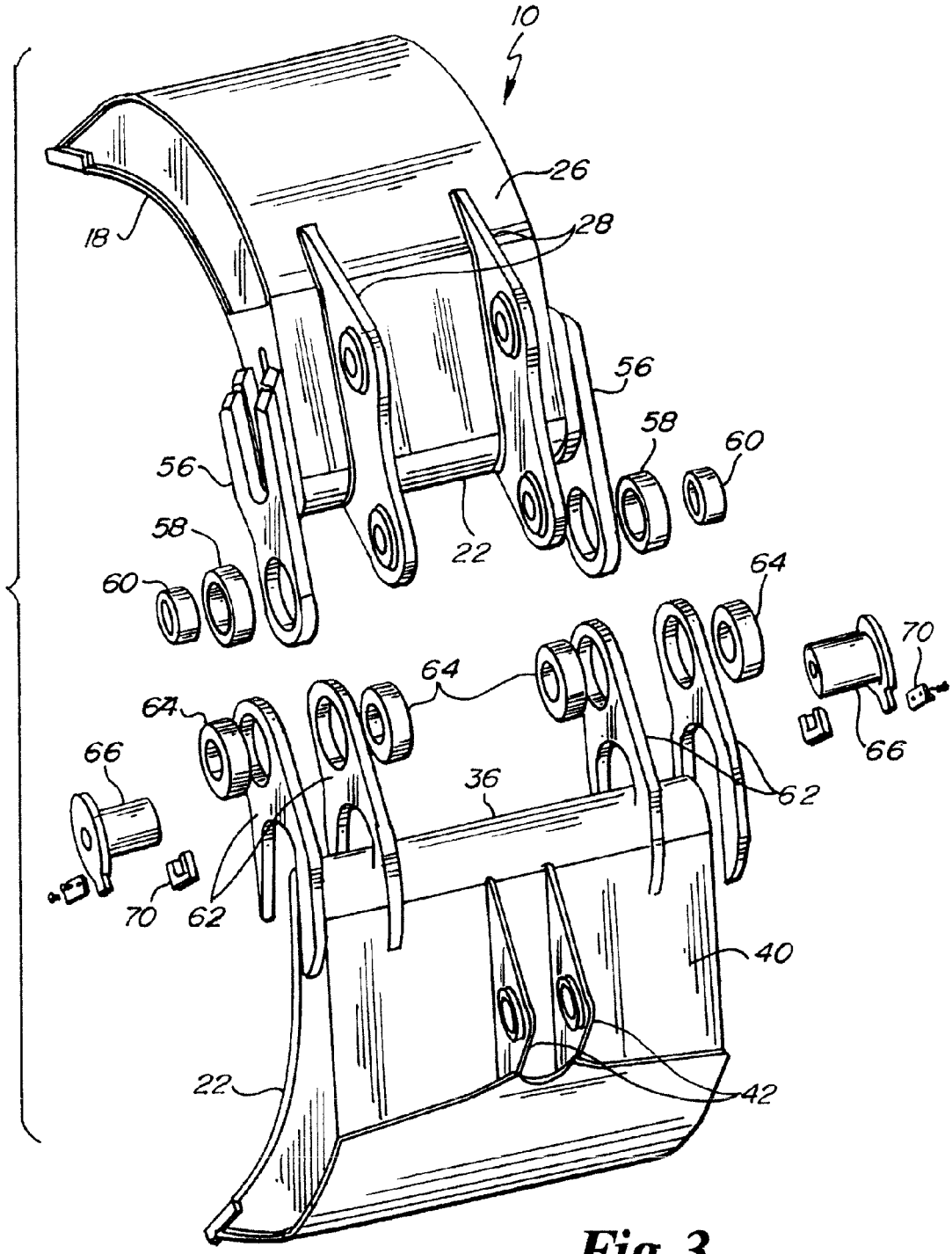
Fig.3 (PRIOR ART)
FIG. 3 is an exploded view of the prior arc grapple assemblies showing the multitude of excessive lug plates, machined sleeves and pivot bushings.
Figure 6:
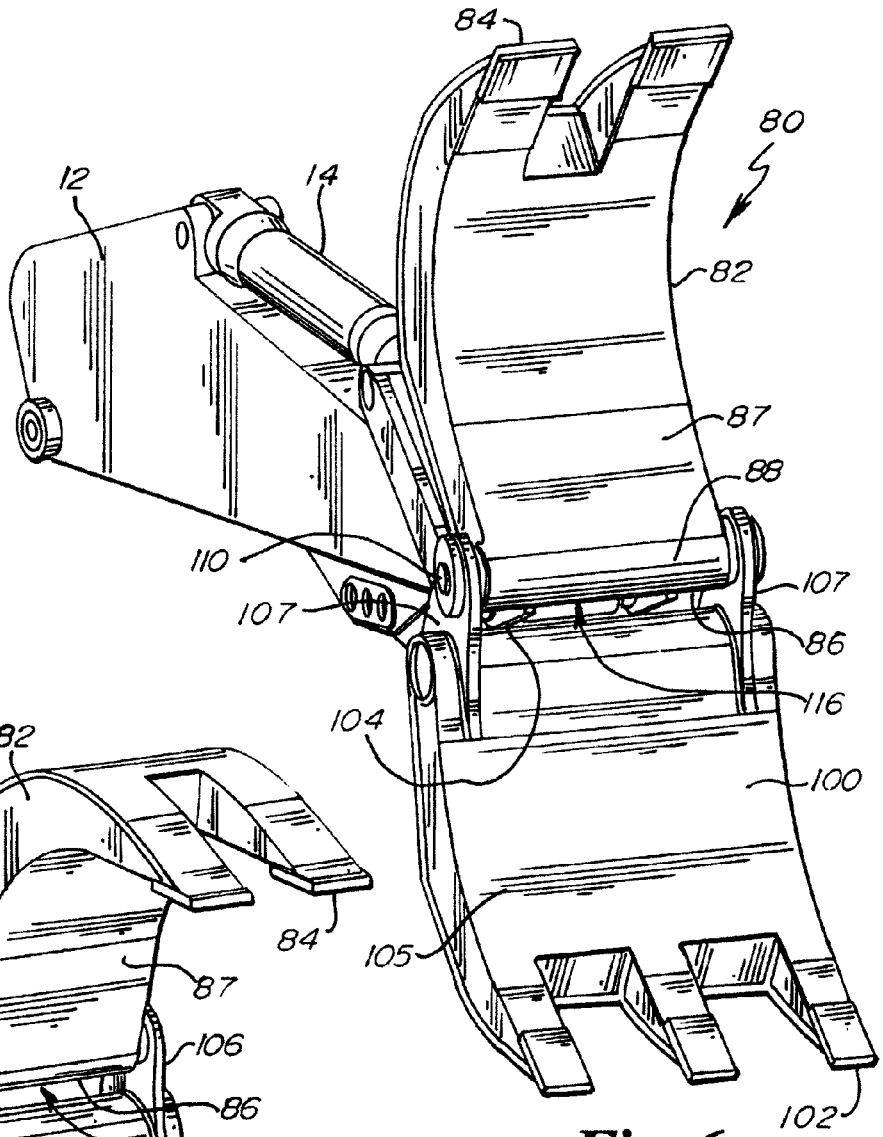
FIG. 6 is a front perspective view of the improved grapple mounted on a dipper stick with its jaws wide open demonstrating the substantially closed throat area.
Figure 4:
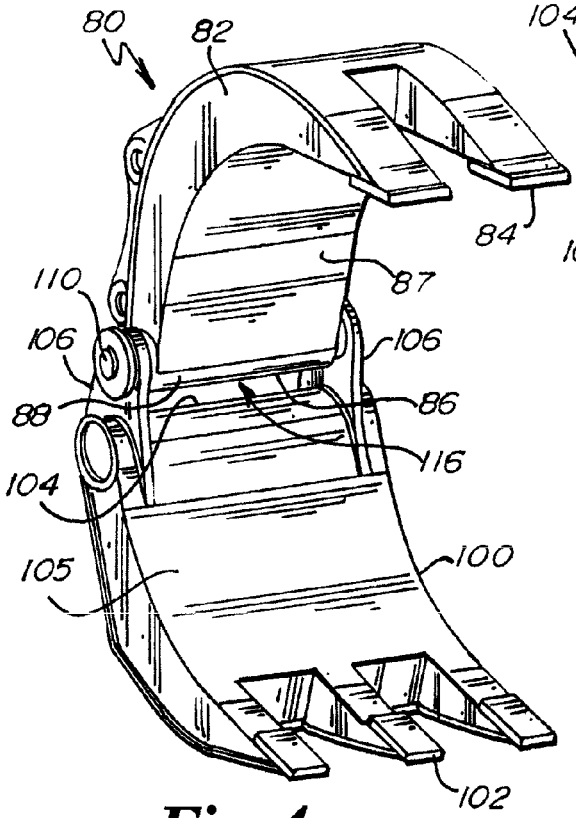
FIG. 4 is a front perspective view of the severe duty grapple with tubular pivot of the present invention.
Figure 5:
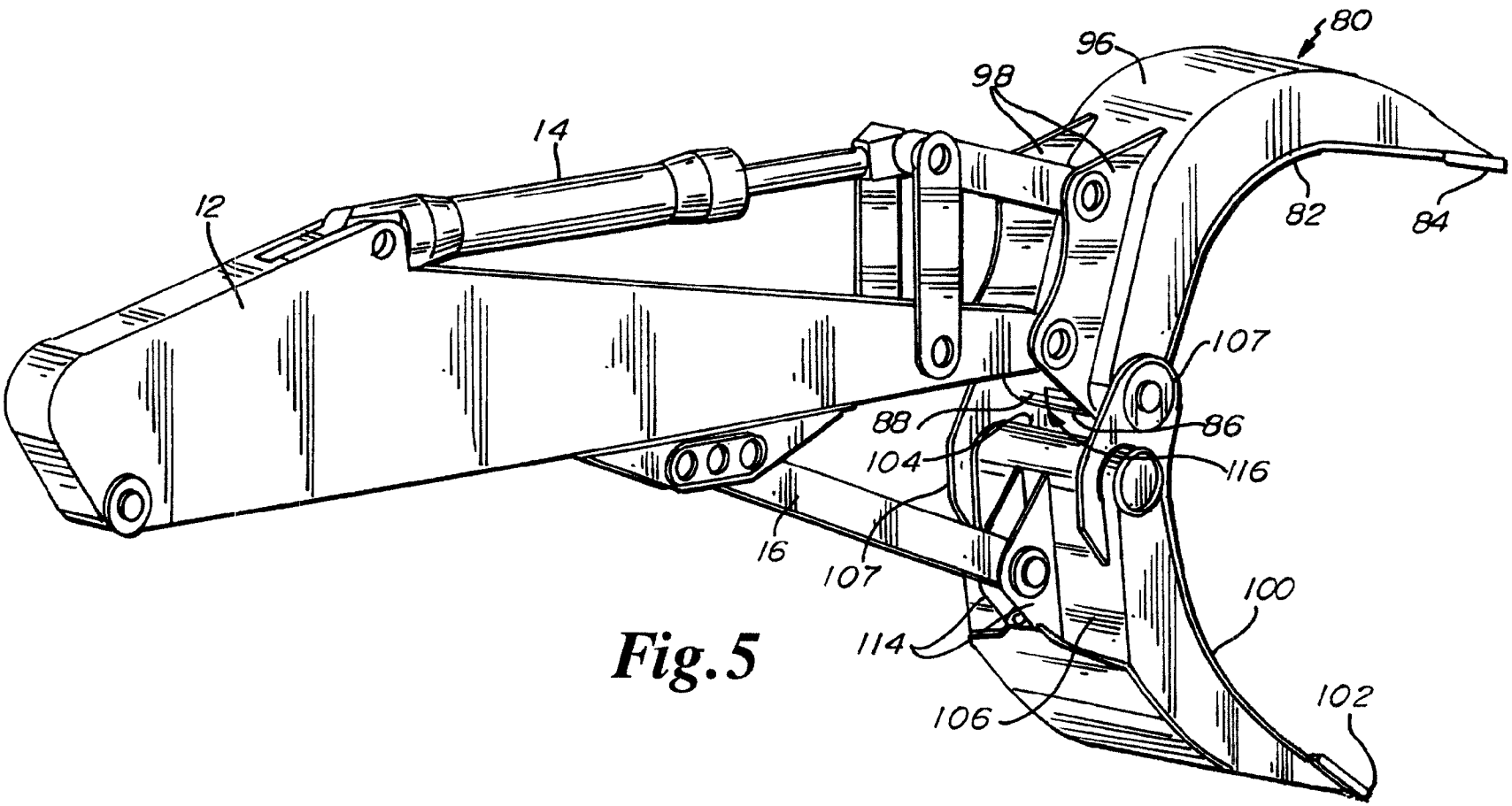
FIG. 5 is a rear perspective view of the present invention mounted on the dipper stick of a backhoe.
Figure 7:
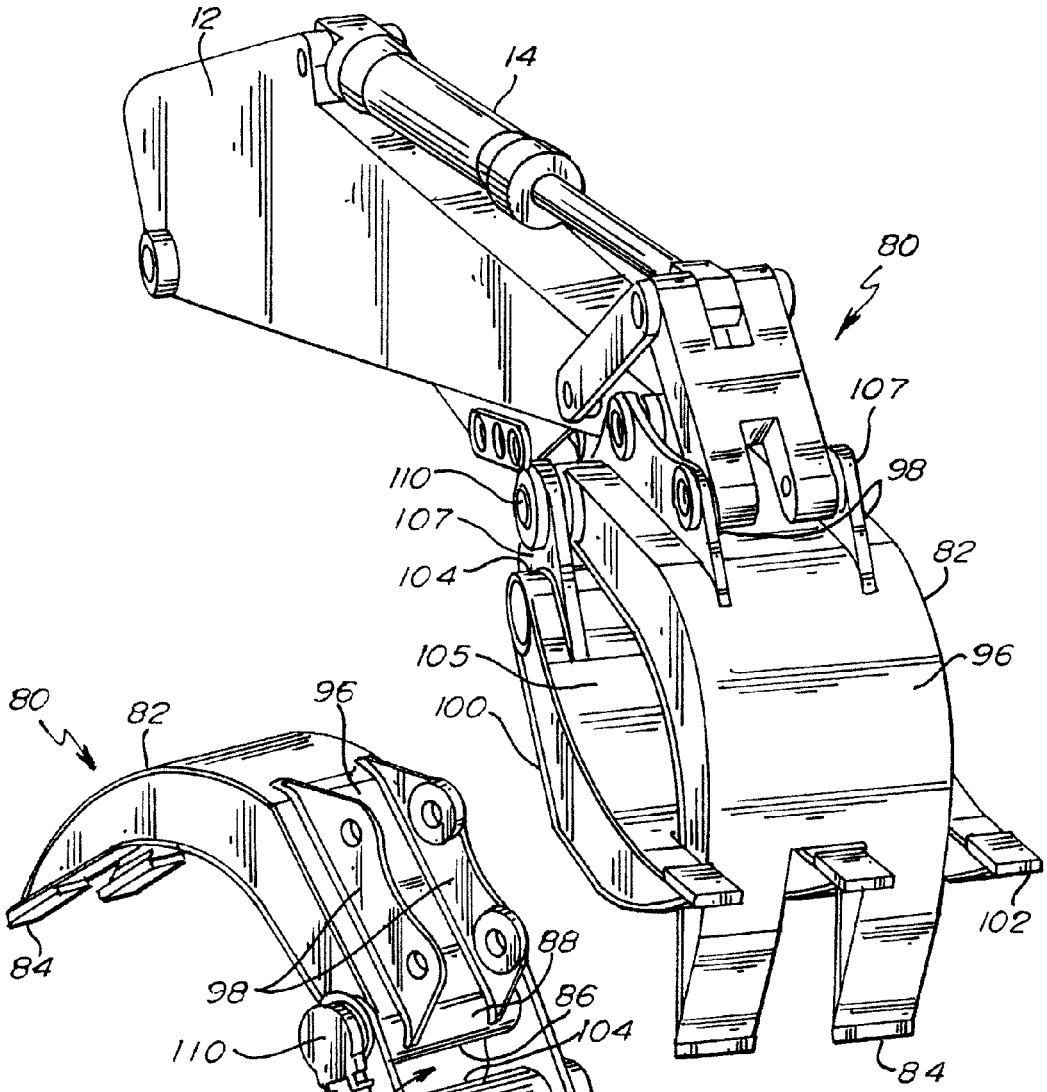
FIG. 7 is a front perspective view of the present grapple mounted on the dipper stick with the jaws completely closed.
Figure 8:
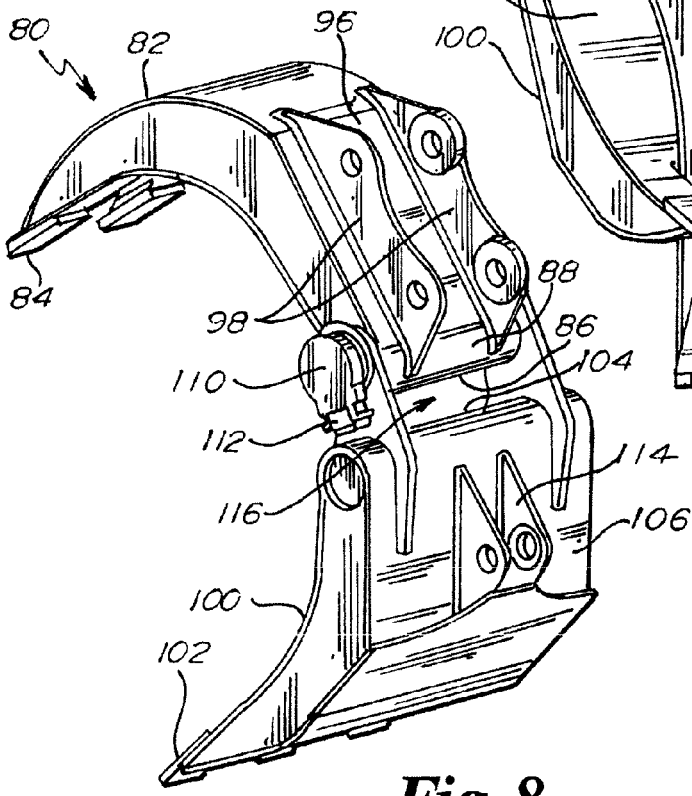
FIG. 8 is a rear perspective view of the present grapple with all the respective mounting plates and only two lug plates.
Figure 9:
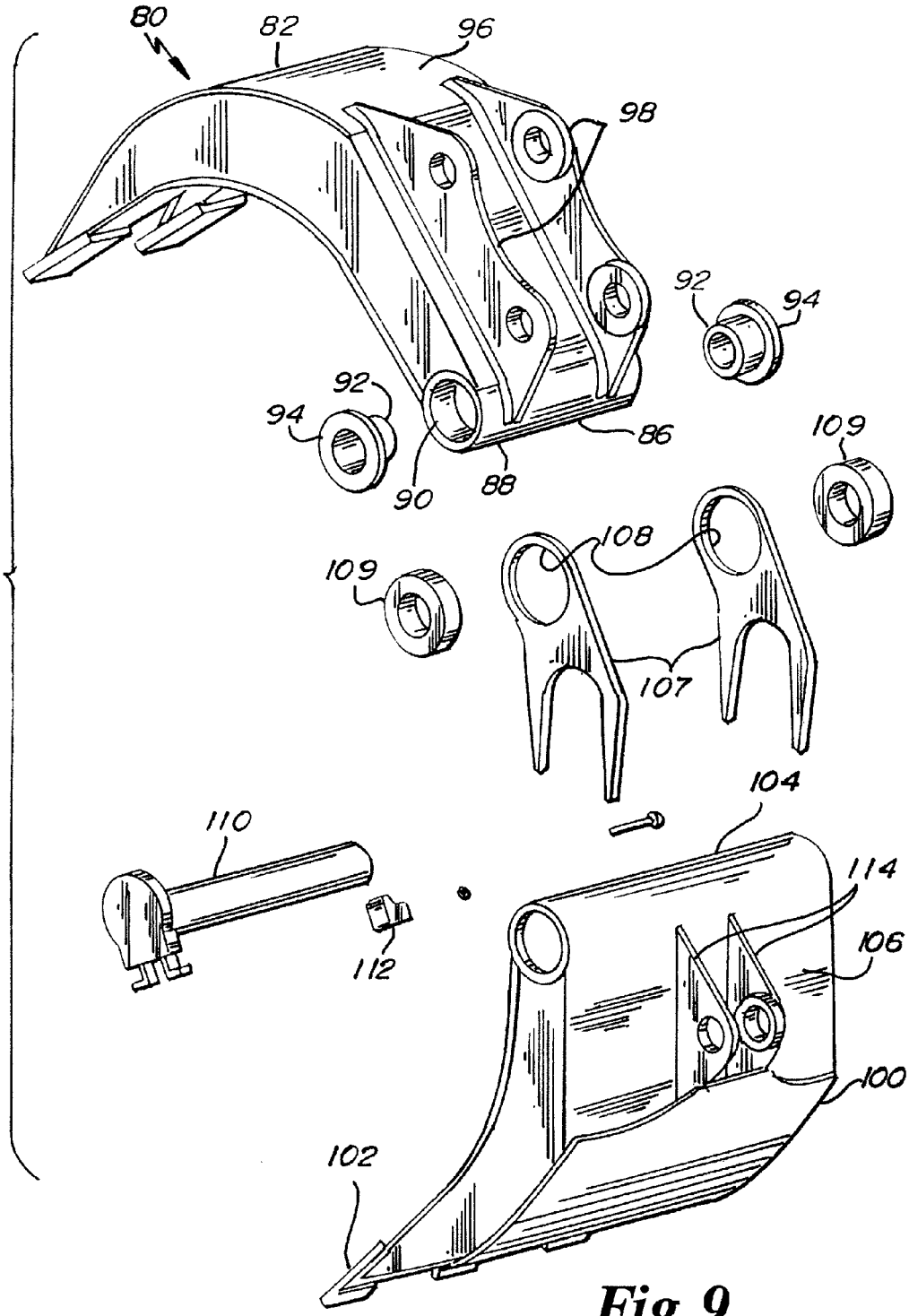
FIG. 9 is a exploded assembly view of the severe duty grapple of the present invention.

Referring to FIGS. 4 through 9, the severe duty grapple 80 with tubular pivot 88 of the present invention may be understood.

The grapple 80 has an arcuate-shaped upper jaw or clam shell 82 with forward rake tips 84 and an inner end 86 between there which are load engaging plates 87. Adjacent the inner end 86 is welded the hollow tubular pivot 88 requiring no lug plates on the upper jaw 82. The tubular pivot 88 could be cylindrical or square in design.

The tubular pivot 88 has opened machined ends 90 which will received pivot bushings 92 each with an outer flange 94. Bushings 92 are suitably made of manganese and bronze. On the backside 96 of the upper jaw 82 are stick mount plates 98.

The arcuate-shaped lower jaw or clam shell 100 also suitably has outward rake tips 102 and an inner end 104 with load engaging plates 105 therebetween. The lower jaw 100 has a backside 106 with two lower lug plates 107 each with an eyelet 108. The lug plates are welded to the inner end 104 of the lower jaw. Machined sleeves 109 are suitably welded into eyelets 108. Pivot pin 110 suitably will pass through and eyelets 108 of the lug plates 107, the two pivot bushings 92 and the tubular pivot 88. The pivot pin 110 is suitably supported by the pivot bushing 92 again suitably made of manganese and bronze. A keeper arrangement 112 is suitably used to keep the pivot pin 110 in proper position. On the back side 106 of lower jaw 100 are stick mount plates 114.

Advantageously, the present invention has a substantially closed throat 116 which will not allow debris to readily get into contact with any pivot groups, linkages, the stick or cylinders that otherwise may cause harm to the grapple assembly 80 or stick 12. It will also be noted that the pivot bushings 92 with flanges 94 permit the upper jaw 82 and lower jaw 100 to not frictionally engage each other but rather together ride on the pivot bushings 92 and flanges 94 which easily may be replaced without substantial downtime and welding.

Figure 10:
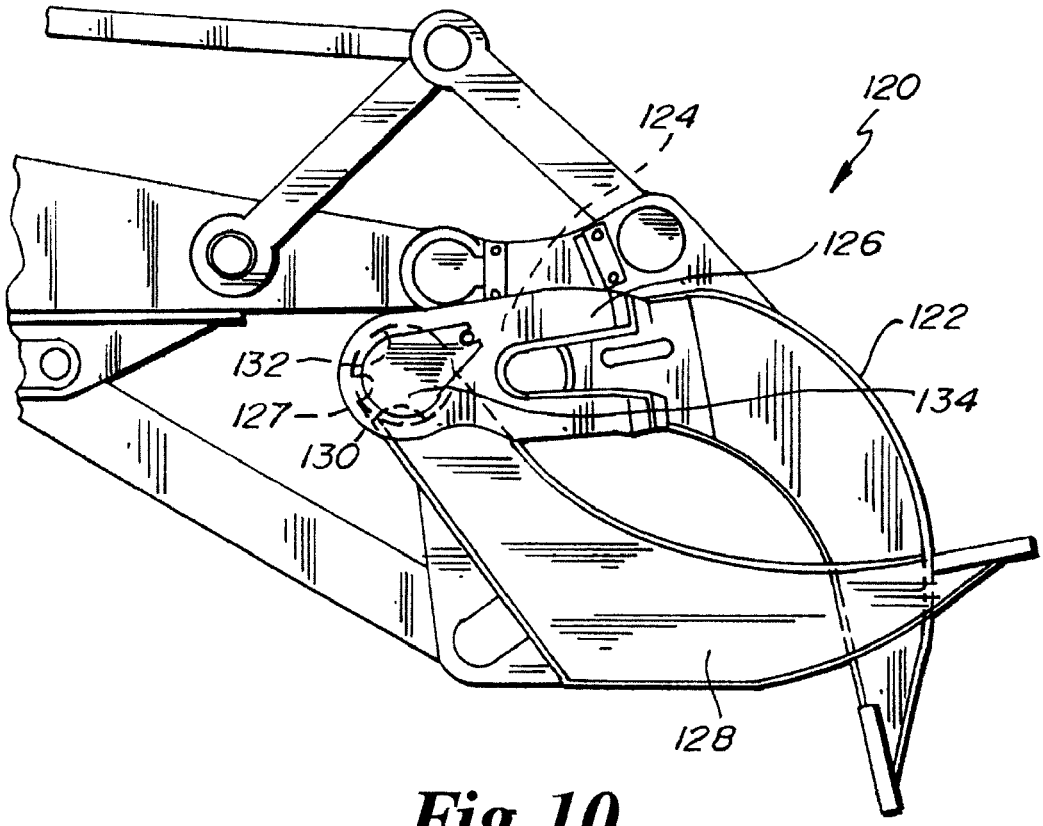
FIG. 10 is a view of the second embodiment of the present severe duty grapple with the tubular pivot on the lower jaw as opposed to the upper jaw.

Referring to FIG. 10, the second embodiment of the severe duty grapple 120 is shown. The arcuate-shaped upper jaw 122 has an inner end 124 onto which are welded upper lug plates 126 each having eyelets 127. The arcuate-shaped lower jaw also has an inner end 130 suitably whereat is welded the hollow tubular pivot 132 which will receive a pivot pin 134 for assembly much like the first embodiment heavy duty grapple 80. The purpose of the second embodiment is to illustrate that the tubular pivot may go onto the inner end of either of the upper jaw or lower jaw.

The present invention is described above and shown in the figures for illustrative purposes only, the actual scope of the present invention is to be understood from a reading of the following claims.

What is claimed is:

1. A severe duty grapple for attachment onto an end of a dipper stick of a backhoe, comprising:

a) an arcuate-shaped upper jaw with an inner end and a back side, the upper jaw pivotally attached near its inner end on its back side to the end of the dipper stick and a double action actuator mounted between the dipper stick and the upper jaw back side for operative pivotal movement of the upper jaw relative to the dipper stick;

b) an arcuate-shaped lower jaw with an inner end and a back side, the lower jaw attached near its inner end on its back side to the dipper stick by a linkage for operative pivotal movement of the upper jaw relative to the lower jaw;

c) a singular hollow tubular pivot attached to the inner end of one of the jaws with open opposing ends, and two lug plates mounted on the inner end of the other jaw, each plate with an eyelet, the eyelets alignable with the open ends of the tubular pivot; and d) a pivot pin passing through the tubular pivot and eyelets.

2. The severe duty grapple of claim 1 wherein the open opposing ends are machined and further comprising a pivot bushing with an external flange in each tubular pivot opening as to not let the upper and lower jaws rub together.

3. The severe duty grapple of claim 2, further comprising the bushing being made of manganese and bronze.

4. The severe duty grapple of claim 1, further comprising rake tips on each jaw opposite their respective inner ends.

5. The severe duty grapple of claim 4, further comprising a load engaging plates between the inner ends and the rake tips of each jaw.

6. The severe duty grapple of claim 1, further comprising a closed throat between the inner ends of the upper and lower jaws.

7. The severe duty grapple of claim 1 wherein there are only two lug plates on the grapple.

8. The severe duty grapple of claim 1 wherein the linkage is a double action actuator for operative pivotal movement of the lower jaw relative to the backhoe stick.

9. A severe duty grapple for attachment onto an end of a dipper stick of a backhoe, comprising:

a) an arcuate-shaped upper jaw with an inner end and a back side, the upper jaw pivotally attached near its inner end on its back side to the end of the dipper stick and a double action actuator mounted between the dipper stick and the upper jaw back side for operative pivotal movement of the upper jaw relative to the dipper stick;

b) an arcuate-shaped lower jaw with an inner end and a back side, the lower jaw attached near its inner end on its back side to the dipper stick by a linkage for operative pivotal movement of the upper jaw relative to the lower jaw;

c) a singular hollow tubular pivot attached to the inner end of one of the jaws with open opposing machined ends, and two lug plates mounted on the inner end of the other jaw, each plate with an eyelet, the eyelets alignable with the open ends of the tubular pivot;

d) a pivot bushing with an external flange in each tubular pivot opening as to not let the upper and lower jaws rub together; and e) a pivot pin passing through the tubular pivot and eyelets.

10. The severe duty grapple of claim 9, further comprising the bushing being made of manganese and bronze.

11. The severe duty grapple of claim 9, further comprising rake tips on each jaw opposite their respective inner ends.

12. The severe duty grapple of claim 11 further comprising a load engaging plates between the inner ends and the rake tips of each jaw.

13. The severe duty grapple of claim 9, further comprising a closed throat between the inner ends of the upper and lower jaws.

14. The severe duty grapple of claim 9 wherein there are only two lug plates on the grapple.

15. The severe duty grapple of claim 9 wherein the linkage is a double action actuator for operative pivotal movement of the lower jaw relative to the backhoe stick.

16. A severe duty grapple for attachment onto an end of a dipper stick of a backhoe, comprising:

a) an arcuate-shaped upper jaw with an inner end and a back side, the upper jaw pivotally attached near its inner end on its back side to the end of the dipper stick and a double action actuator mounted between the dipper stick and the upper jaw back side for operative pivotal movement of the upper jaw relative to the dipper stick;

b) an arcuate-shaped lower jaw with an inner end and a back side, the lower jaw attached near its inner end on its back side to the dipper stick by a linkage for operative pivotal movement of the upper jaw relative to the lower jaw;

c) rake tips on each jaw opposite their respective inner ends and load engaging plates between the inner ends and the rake tips of each jaw;

d) a singular hollow tubular pivot attached to the inner end of the upper jaw with open opposing machined ends, and two lug plates mounted on the inner end of the lower jaw, each plate with an eyelet alignable with one of open ends of the upper jaw tubular pivot;

e) a pivot bushing with an external flange in each tubular pivot opening as to not let the upper and lower jaws rub together; and f) a pivot pin passing through the tubular pivot and eyelets forming a closed throat.

17. The severe duty grapple of claim 16, further comprising the bushing being made of brass and manganese.

18. The severe duty grapple of claim 16, wherein the linkage is a double action actuator for operative pivotal movement of the lower jaw relative to the backhoe stick.

* * * * *